US006356180B1

(12) United States Patent
Masuda et al.

(10) Patent No.: US 6,356,180 B1
(45) **Date of Patent: *Mar. 12, 2002**

(54) HIGH-VOLTAGE GENERATING TRANSFORMER

(75) Inventors: Kenichi Masuda; Tutomu Hasegawa; Fuminori Teramoto, all of Tsurugashima (JP)

(73) Assignee: Toyo Denso Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/013,865

(22) Filed: Jan. 27, 1998

(30) Foreign Application Priority Data

Jan. 28, 1997 (JP) ..... 9-049549

(51) Int. Cl.[7] ..... H01F 27/28
(52) U.S. Cl. ..... 336/198; 336/225; 336/226; 336/190
(58) Field of Search ..... 336/189, 190, 336/191, 198, 208, 225, 174, 226

(56) References Cited

U.S. PATENT DOCUMENTS 1,638,996 A * 8/1927 Holman ..... 336/226
2,282,386 A * 5/1942 Sinninger ..... 336/189
2,763,805 A * 9/1956 Bendell ..... 336/189
2,813,255 A * 11/1957 Williams et al. ..... 336/189
2,942,212 A * 6/1960 Mynall ..... 336/225
3,419,837 A * 12/1968 Marshall ..... 336/190
3,449,703 A * 6/1969 Steen ..... 336/174
4,238,753 A * 12/1980 Bayer ..... 336/198
4,255,735 A * 3/1981 Liautaud ..... 336/192
4,334,206 A * 6/1982 Nakamura ..... 336/198
4,509,033 A * 4/1985 Weiss et al. ..... 336/198
4,808,959 A * 2/1989 Weissman ..... 336/189

* cited by examiner

*Primary Examiner*—Anh Mai
(74) *Attorney, Agent, or Firm*—Lyon & Lyon LLP

(57) ABSTRACT

In a high-voltage generating transformer having primary and secondary coil bobbins coaxially mounted on one another relative to a center core, an element wire of the primary coil is wound spirally around the primary coil bobbin in such a way that the both staring and terminating ends of the wire are disposed at the same end of the coil bobbin by forward and backward winding of the wire. This enables the transformer to have considerably reduced number of turns of the wires in the primary coil relative to that in the secondary coil, thus improving the voltage transformation ratio and obtaining a sufficiently high voltage at the secondary side.

11 Claims, 5 Drawing Sheets

HIGH-VOLTAGE GENERATING TRANSFORMER

BACKGROUND OF THE INVENTION

The present invention relates to a high-voltage generating transformer and particularly to a high-voltage generating transformer for use in a discharge lamp lighting circuit for a headlight of a vehicle.

A conventional high-voltage generating transformer of the type that a primary coil-wound bobbin and a secondary coil-wound bobbin are assembled coaxially relative to a center core has a large size because of providing a large transformer ratio (i.e., the ratio of the number of turns in the secondary winding to the number of the primary winding) to produce a high voltage at the secondary side of the transformer.

A typical attempt has been made to reduce in size and weight a conventional transformer by reducing the number of turns in its primary coil to 3–5 turns and correspondingly reducing the number of turns in the secondary coil. However, the attempt resulted in that the working efficiency of the transformer was decreased by an increased leakage of magnetic flux resulted from the decreased coverage ratio of the primary coil to the secondary coil.

As described above, the conventional high-voltage generating transformer having coaxially mounted primary and secondary coil-wound bobbins with a center core may be reduced in size and weight by considerably reducing the number of turns in the primary winding to 3–5 but encounters a problem of increasing leakage of magnetic flux and decreasing the working efficiency. This makes the transformer be unable to generate a sufficiently high secondary voltage.

SUMMARY OF THE INVENTION

Accordingly, an object of the present invention is to provide a high-voltage generating transformer having coaxially mounted primary and secondary coil-wound bobbins with a center core, which is reduced in size and weight by minimizing the number of turns in the primary winding and, at the same time, can obtain a sufficiently high voltage at its secondary side, effectively preventing leakage of magnetic flux. This is realized by spirally winding an element wire around the primary coil bobbin in forward and backward direction to form thereon the primary coil whose axial length is long enough to meet with the secondary coil and whose starting and terminating ends are disposed at the same side of the bobbin.

DESCRIPTION OF THE PREFERRED EMBODIMENTS

Figure 1:
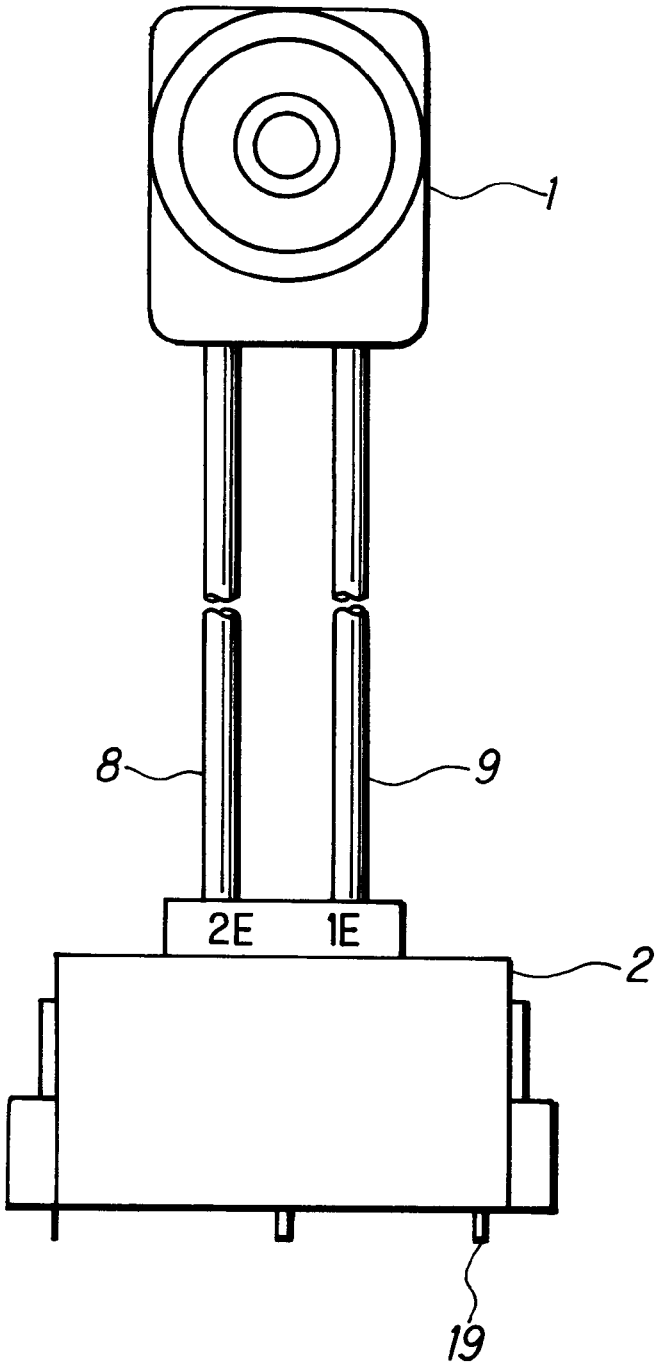
FIG. 1 is illustrative of an arrangement of a discharge lamp socket and a high-voltage generating transformer used in a lamp-lighting circuit.

FIG. 1 is illustrative of an exemplified arrangement of a discharge lamp socket 1 and a high-voltage generating transformer 2 for a circuit for lighting a discharge lamp used as a headlight of a vehicle.

Figure 2:
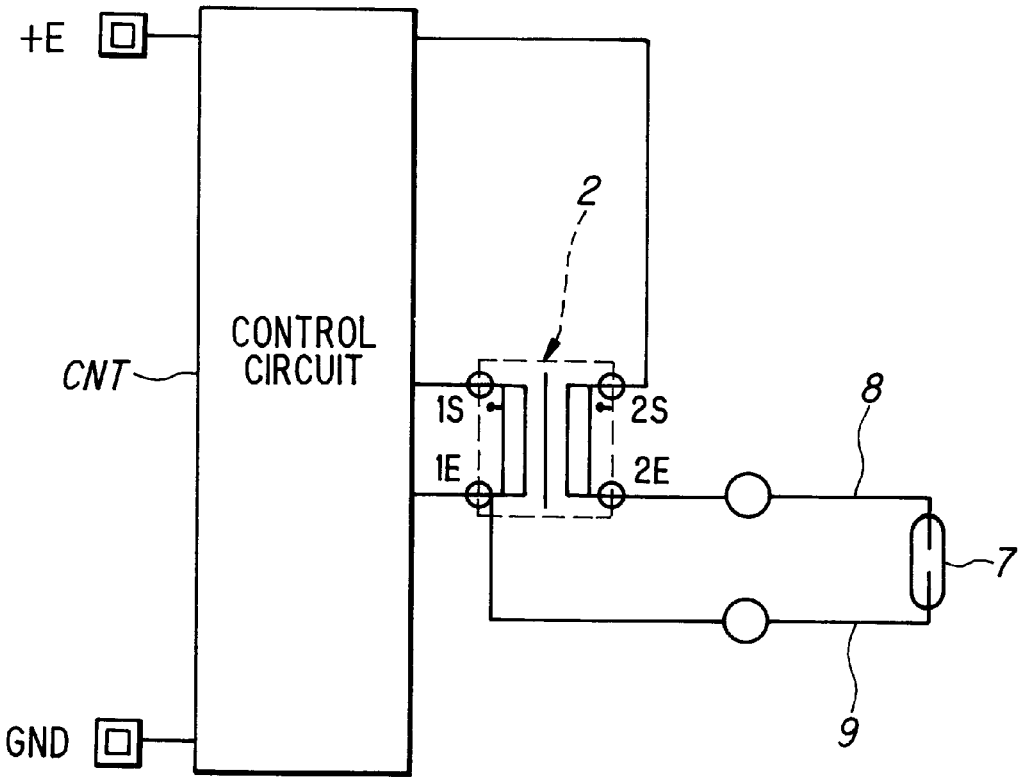
FIG. 2 is a block diagram of a discharge lamp lighting circuit.
Figure 3:
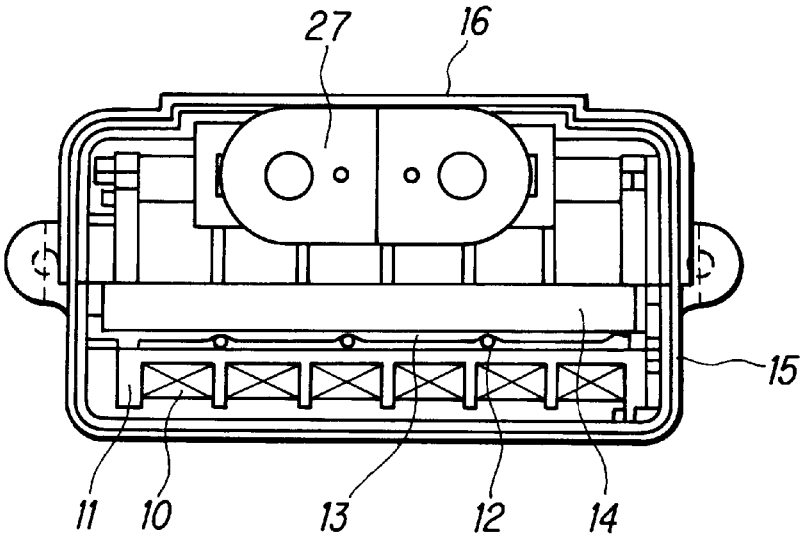
FIG. 3 is a plan view of a high-voltage generating transformer embodying the present invention.
Figure 4:
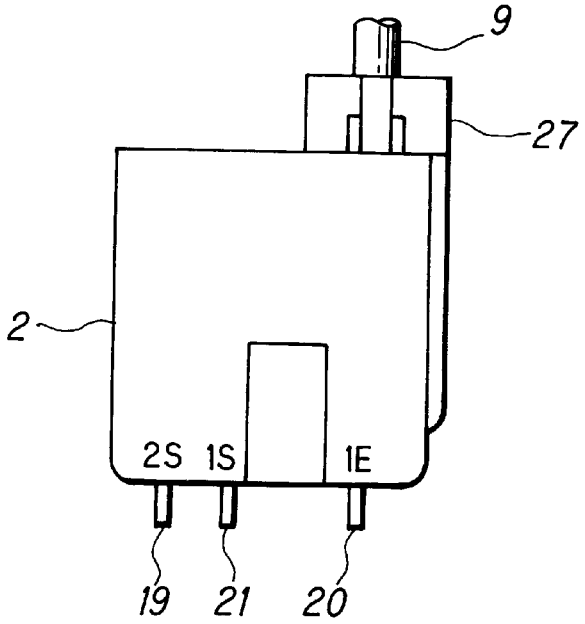
FIG. 4 is a side view of the high-voltage generating transformer of FIG. 3.
Figure 5:
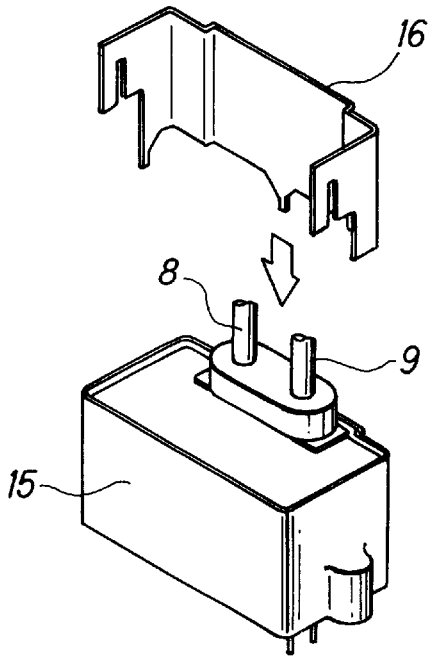
FIG. 5 is a perspective illustration of the high-voltage generating transformer of FIG. 3.
Figure 6:
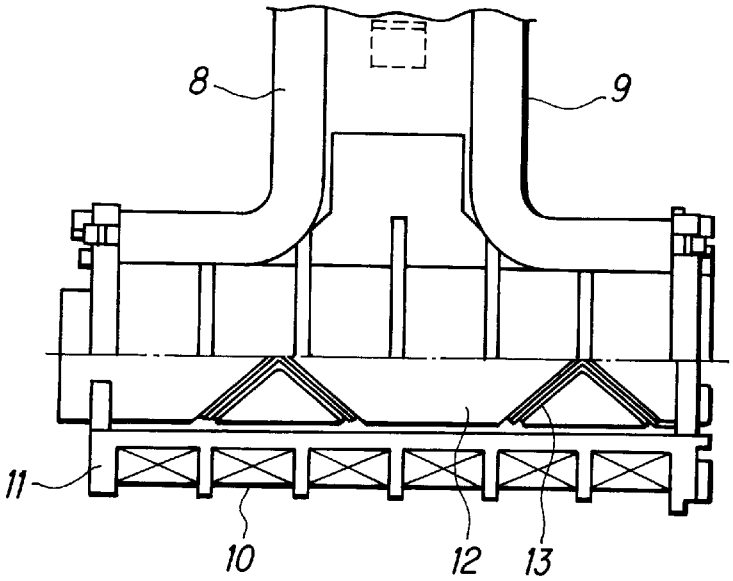
FIG. 6 is a front view of a coil unit of the high-voltage generating transformer of FIG. 3.

FIG. 2 is illustrative of a lamp-lighting circuit for lighting a discharge lamp 7, which includes a control circuit CNT that receives a driving voltage E (DC 400V) when a lamp switch (not shown) is turned on and the controlled voltage is applied to the primary side of the high-voltage generating transformer 2 that in turn produces at its secondary side a high voltage (about 25 KV) for lighting the discharge lamp 7. After firing the discharge lamp 7 by applying the high voltage for an initial firing period, the control circuit CNT operates to directly supply the discharge lamp with a working voltage (100V) through the secondary side coil of the high-voltage generating transformer T to maintain the lamp in a lightning mode.

In FIGS. 1 and 2, numeral 8 designates a high-voltage cable for the high-voltage side (2E) of the high-voltage generating transformer 2 and numeral 9 designates a high-voltage cable for the low-voltage side (1E) of the transformer.

The high-voltage generating transformer 2 according to the present invention is constructed as shown in FIGS. 3 to 8.

As shown in FIGS. 3 to 6, a coil bobbin 11 with a secondary coil 10 wound thereon and a rod-like core 14 inserted in the bobbin's hollow center is mounted in a coil case 15 made in the form of an open-top tub. After wiring of the coil ends as described later, all inside components are then integrally potted in the coil case 15 with insulating resin poured in a melted state and solidified therein. The coil case 15 is further provided at its side portion with a protecting cover 16 being channel-shaped in cross section, which fits on the case 12 by its spring force of both wings to shut off the possible effect of a high-voltage to other external circuit components.

Figure 9:
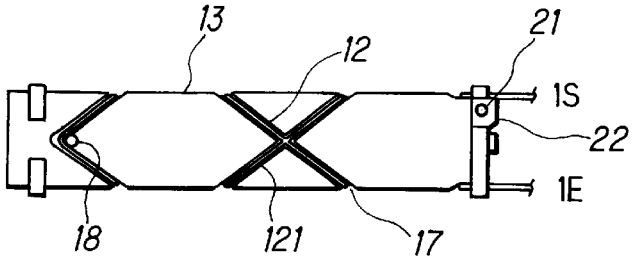
FIG. 9 is a plan view of a primary coil bobbin of the high-voltage generating transformer of FIG. 3.

In the transformer according to the present invention, as seen in FIG. 9, an element wire 121 is spirally wound around a primary coil bobbin 13 in forward and backward directions to form thereon a primary coil 12 of which the axial length is substantially equal to that of the secondary coil and of which the starting and terminating ends (1S) and (1E) are disposed at the same end of the bobbin 13. The primary coil bobbin 13 has guiding grooves 17 spirally cut therearound for spiral winding the element wire 121 and a pin 18 formed at turning point thereof for supporting the returning part of the wire 121.

The ratio of the number of turns in the primary coil 12 to the number of turns in the secondary coil is within the range of 1:90–100 to obtain a voltage of about 25 KV at the secondary side of the transformer.

The considerable reduction of the number of turns of the primary coil 12 enables the corresponding reduction of the number of turns of the secondary coil 10, realizing the saving in size and weight of the whole transformer. In this case, the leakage of magnetic flux is effectively prevented since the primary coil has an axial length substantially equal to that of the secondary coil. The spiral winding of the element wire around the primary bobbin 13 along the forward and backward guiding grooves 17 eliminates the problem that a magnetic flux produced by the forward winding cancels a magnetic flux produced by the backward winding of the primary coil due to the opposite directions of both fluxes. Consequently, the transformer attains an improved efficiency of transforming a voltage between the primary and secondary windings and can produce a sufficiently high voltage at the secondary side.

Figure 7:
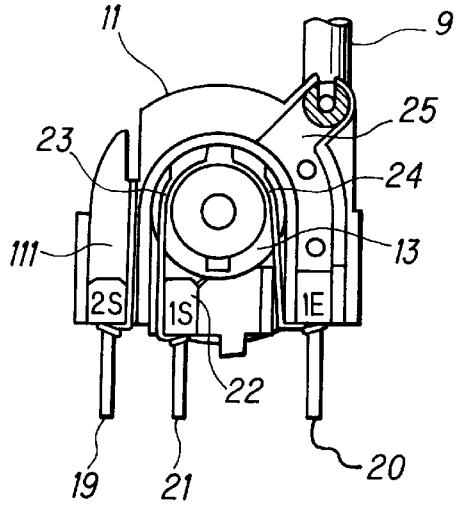
FIG. 7 is a right-side view of a coil unit of the high-voltage generating transformer of FIG. 3.
Figure 8:
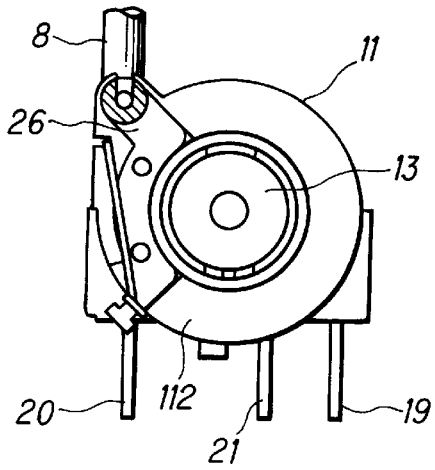
FIG. 8 is a left-side view of a coil unit of the high-voltage generating transformer of FIG. 3.

As seen in FIG. 7, a secondary coil bobbin 11 is provided at one flanged end with a terminal pin 19 for connecting thereto the starting end (2S) of the secondary coil (10) and a terminal pin 20 for connecting thereto a terminating end of the primary coil (1E). The primary coil bobbin 13 is provided at one end with a seat 22 with a terminal pin 21 for securing the starting end (1S) of the primary coil 12.

The primary coil bobbin 13 is provided at one flanged end with grooves 23 and 24 formed thereon for temporally holding the starting end (1S) and terminating end (1E), respectively, of the primary coil wire.

The coil case 15 has through holes (not shown) in its bottom for fitting-in and projecting the terminal pins 19–21 of the coil unit when mounted in the coil case 15.

The high-voltage generating transformer 2 can be directly mounted on a printed circuit board by connecting the terminal pins 19–21 projected from the bottom of the coil case 15.

The secondary coil bobbin 11 is provided at its flanged end 111 with a terminal 25 connected with the terminal pin 20 securing thereto the terminating end (1E) of the primary coil 12. This terminal 25 is used for connecting thereto a high-voltage cable 9 of the low-voltage side of the transformer.

The secondary coil bobbin 11 is provided at its other flanged end 112 with a terminal 26 for securing thereto the terminating end (2E) of the secondary coil 12. This terminal 26 is also used for connecting thereto a high-voltage cable 8 of the high-voltage side of the transformer.

The coil case 15 is provided with a cable holder 27 formed as projecting therefrom for leading out the high-voltage cables 8 and 9 from the coil case 15. The cable holder 27 has a base fitted in a supporting portion formed on the inside wall of the coil case 15 and integrally formed with insulating resin poured in a melted state and solidified in the coil case 15.

In the high-voltage generating transformer, the coil assembly can be easily mounted in the coil case 15 with no need for laying therein additional wiring between the ends of the primary and secondary coils 10, 12, their terminals and high-voltage cables 8, 9 that can easily be leading out of the coil case 15. All mounting and wiring works can be effectively performed in good order.

As will be apparent from the foregoing, the high-voltage transformer according to the present invention has a primary coil-wound bobbin and a secondary coil bobbin, both of which are coaxially assembled about a center core and which primary coil is formed on the primary coil bobbin by spirally winding an element wire in the forward direction and the backward direction thereon to have both ends disposed at the same end of the bobbin and to have a very small number of turns in the coil but with the same axial length as that of the secondary coil. This construction can effectively prevent leakage of magnetic flux produced and can also eliminate a problem that the magnetic flux produced by the forward winding and the magnetic flux produced by the backward winding cancels each other due to the opposite directions of the fluxes. Therefore, the transformer can have an increased efficiency of transforming a voltage between the primary and secondary windings. Namely, the transformer can produce a sufficiently high voltage at its secondary side.

What is claimed is:

1. A high-voltage generating transformer comprising a primary coil-wound bobbin and a secondary coil-wounded bobbin, both said bobbins being cylindrical and coaxially mounted with a rod-shaped center core, wherein a first element wire is spirally wound around the primary coil bobbin in a forward direction and then in a backward direction to form the primary coil whose starting end and terminating end are disposed at the same end of the bobbin, said primary coil having about three to about five turns and being wound with an axial length substantially equal to a wound axial length of the secondary coil.

2. The high-voltage generating transformer of claim 1, wherein said primary bobbin has a single continuous spiral groove from said end to another end and back to said end in the same circumferential direction for receiving and retaining said first element wire.

3. The high-voltage generating transformer of claim 2, wherein a pin is provided on said primary bobbin at said another end for said first element wire to engage for reversing the winding direction of said element wire from forward to backward.

4. The high-voltage generating transformer of claim 1, wherein a starting end of a second element wire wound on said secondary bobbin is at the same end of said secondary bobbin as said starting end and terminating end of said first element wire.

5. The high-voltage generating transformer of claim 7, wherein a terminating end of said second element wire is at an opposite end of said secondary bobbin from said starting end.

6. The high-voltage generating transformer of claim 1, wherein a pair of diametrically opposed grooves are provided on said end of said primary bobbin, said pair of grooves extending laterally of said primary bobbin for receiving said starting and terminating end, respectively, of said first element wire.

7. The high-voltage generating transformer of claim 1, wherein said secondary coil-wound bobbin includes a second element wire spirally wound to encircle the secondary coil bobbin at least 90 times more than said first element wire encircles the primary coil bobbin.

8. A high-voltage generating transformer comprising a primary coil-wound bobbin and a secondary coil-wound bobbin, both said bobbins coaxially mounted with a rod-shaped center core, wherein a first element wire is spirally wound around the primary coil bobbin only once in a forward direction and only once in a backward direction to form the primary coil whose starting end and terminating end are disposed at the same end of the bobbin, said primary coil encircling said primary coil bobbin about three to about five times and being wound with an axial length substantially equal to a wound axial length of the secondary coil.

9. The high-voltage generating transformer of claim 8, wherein said secondary coil-wound bobbin includes a second element wire spirally wound to encircle the secondary coil bobbin at least 90 times more than said first element wire encircles the primary coil bobbin.

10. A high-voltage generating transformer comprising a primary coil-wound bobbin and a secondary coil-wound bobbin, each said bobbin having a cylindrical portion of the same length as the other said bobbin and a common central axis, both said bobbins being coaxially mounted with said cylindrical portions radially aligned and a rod-shaped center core, wherein a first element wire is spirally wound around the primary coil bobbin once in a forward direction winding and then once in a backward direction winding to form the primary coil whose starting end and terminating end are disposed at the same end of the bobbin, said primary coil having only those two windings and encircling said primary about three to about five times, said primary coil being wound with an axial length substantially equal to a wound axial length of the secondary coil.

11. The high-voltage generating transformer of claim 10, wherein said secondary coil-wound bobbin includes a second element wire spirally wound to encircle the secondary coil bobbin at least 90 times more than said first element wire encircles the primary coil bobbin.

* * * * *